US005829166A

United States Patent [19]

Klas

[11] Patent Number: 5,829,166

[45] Date of Patent: Nov. 3, 1998

[54] AIR-CUSHION NOZZLE FOR DRYING APPARATUS

[75] Inventor: Ernst Klas, Siegburg, Germany

[73] Assignee: VITS Maschinenbau GmbH, Langenfeld, Germany

[21] Appl. No.: 855,680

[22] Filed: May 14, 1997

[30] Foreign Application Priority Data

May 15, 1996 [DE] Germany ..... 196 19 547.0

[51] Int. Cl.[6] ..... F26B 13/00

[52] U.S. Cl. ..... 34/641; 226/97.3; 242/615.11; 34/655; 34/460

[58] Field of Search ..... 34/640, 641, 655, 34/638, 460; 226/97.3, 615.11

[56] References Cited

U.S. PATENT DOCUMENTS

| | | | |
|---|---|---|---|
| 4,058,244 | 11/1977 | Vits | 34/640 |
| 4,074,841 | 2/1978 | Kramer | 226/97.3 |
| 4,290,210 | 9/1981 | Johansson | 34/156 |
| 4,308,984 | 1/1982 | Vits | 226/97.3 |
| 4,384,666 | 5/1983 | Koponen et al. | 226/97.3 |
| 4,932,140 | 6/1990 | Lepisto | 34/641 |
| 5,014,447 | 5/1991 | Hagen | 34/641 |
| 5,299,364 | 4/1994 | Heikkila et al. | 34/460 |

FOREIGN PATENT DOCUMENTS

| | | |
|---|---|---|
| 26 15 258 | 10/1977 | Germany . |
| 26 13 135 | 3/1978 | Germany . |
| 43 13 543 | 4/1994 | Germany . |
| 296 02 178 | 4/1996 | Germany . |
| 2141989 | 1/1985 | United Kingdom . |

*Primary Examiner*—William Doerrler
*Attorney, Agent, or Firm*—Herbert Dubno; Andrew Wilford

[57] ABSTRACT

An air-cushion nozzle for an air-treatment device has a hollow housing having an upper wall formed by a pair of end plates and a central plate. The end plates form with the central plate a pair of generally parallel slots directed upwardly generally toward each other and one of the end plates is formed adjacent and along a full length of the respective slot with an array of throughgoing holes. The central plate is substantially imperforate between the slots. The housing is internally pressurized, normally with hot air, to form from each slot an upwardly directed elongated jet of air and from each of the holes a respective upwardly directed further jet of air.

13 Claims, 6 Drawing Sheets

AIR-CUSHION NOZZLE FOR DRYING APPARATUS

FIELD OF THE INVENTION

The present invention relates to an air-cushion nozzle for a drying apparatus. More particularly this invention concerns such nozzles used in a dryer through which a web is passed, with the web supported and dried by air cushions created by the nozzles.

BACKGROUND OF THE INVENTION

In the treatment of paper or textile webs it is standard to run the web horizontally through a drying apparatus provided with upper and lower arrays of air-cushion nozzles. Each such nozzle emits a volume of air that serves to dry the web, to transport the web through the machine, and to support the web without physical contact with any parts of the machine. Such machines are used to dry a freshly printed paper web, to heat treat a metal sheet, and to dry a paper or textile web after some kind of wet treatment.

Figure 5:
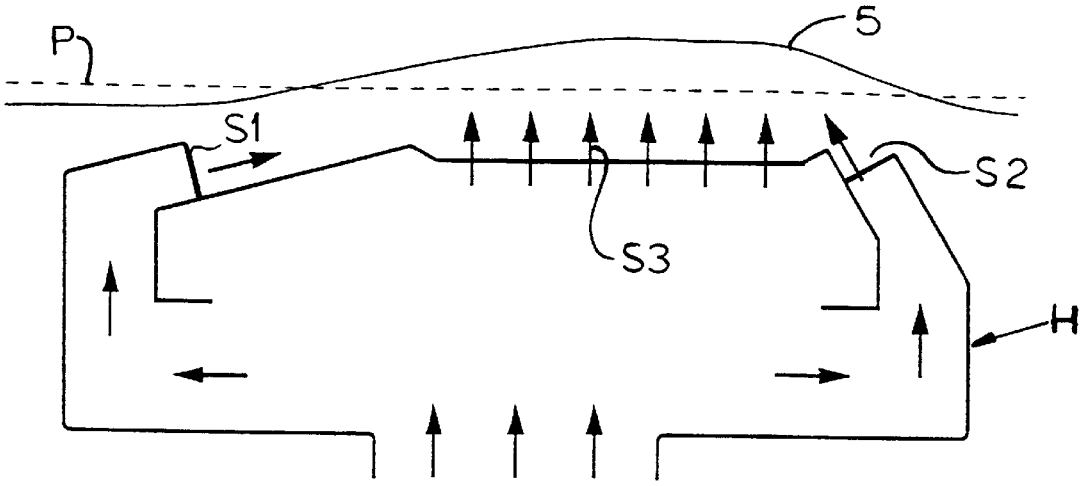
FIG.5 PRIOR ART
FIG. 5 is a schematic view illustrating a prior-art air-cushion nozzle.

As described in German patents 2,613,135 of Vits, 2,615,258 also of Vits, and 4,313,543 of Hago as well as in German Utility Models 74, 35 572 and 296 02 178, such nozzles normally comprise as shown in FIG. 5 a closed housing H arranged underneath a plane P along which a web 5 is transported. The inside of the housing H is pressurized with hot air and its upper wall is formed with a pair of slots S1 and S2 that are directed generally toward each other at acute angles to the plane P, and an array of central holes S3. Thus air will exit this housing H as a pair of elongated angled jets emanating from the slots S1 and S2 and a plurality of smaller vertical jets from the holes S3. As illustrated, the result is to lift the web 5 above the housing H, but normally in such a manner that it is in fact lowered at the upstream end of the housing H where it can come dangerously close to and even touch the housing H.

Normally the upstream slot is of larger flow cross section than the downstream slot and/or is directed at a flatter angle to the horizontal to ensure good movement of the web 5 through the apparatus. Above-cited German 2,615,258 employs this asymmetry, setting the upstream slot at 10° to 30°, preferably 15° to 20°, to the horizontal and the downstream slot at 45° to 80°, preferably 60° to 65°.

A defect of the known systems is that they tend to leave the web damp at the edges. The middle part of the web is dried thoroughly, but air exchange at the edges is reduced so drying there is not as good. While above-cited German 4,313,543 aims at an air distribution that is greater toward the web edges, this system still produces inadequate results. In addition this system is relatively expensive to build and substantial experimentation is needed to get it working right in a given production line. In particular it is difficult to guide the web accurately with such an arrangement, in particular when as is common the web holds liquid equal to 130% or more of its weight.

Figure 7:
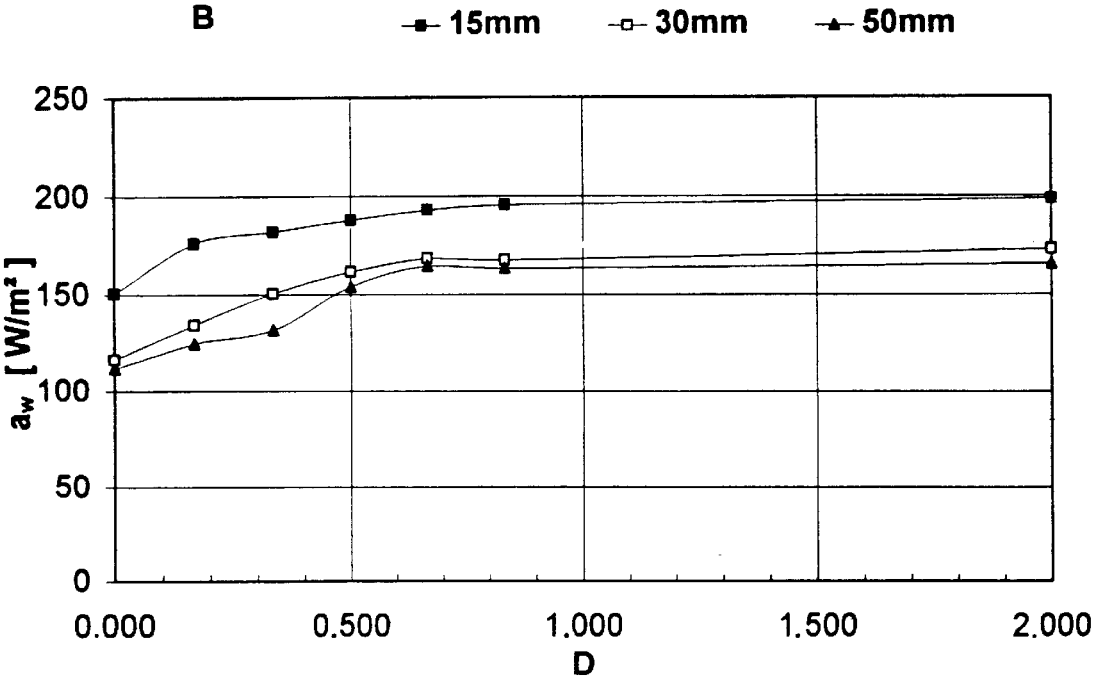
FIG.7 PRIOR ART
FIGS. 7 and 8 are graphs illustrating drying at edge regions of a web in a prior-art system.
Figure 8:
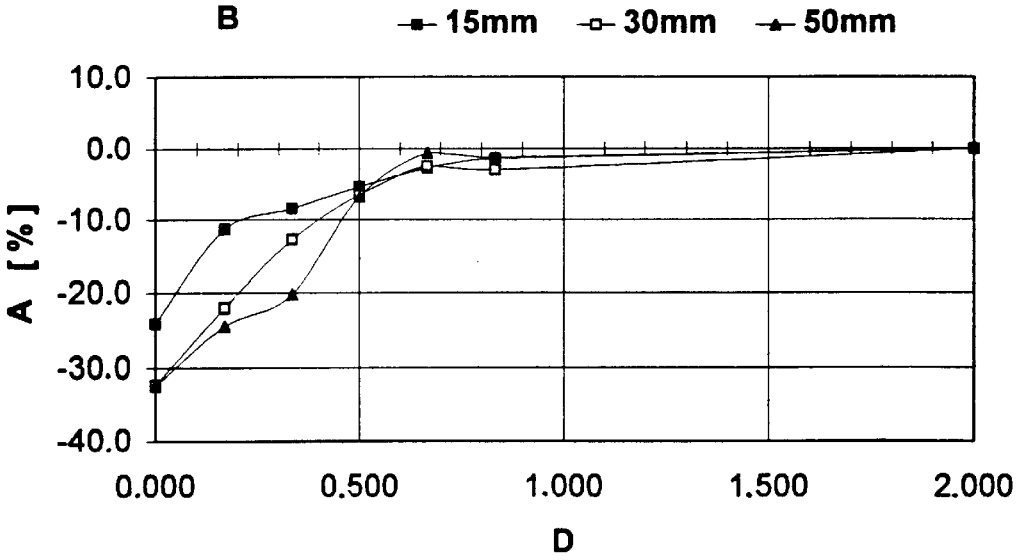
FIG.8 PRIOR ART

As shown in FIGS. 7 and 8, measurements of the heat-exchange coefficient $a_w$ of the flow of a standard air-cushion nozzle with holes in the central plate against the relative spacing D from the edge of the web, that is of the spacing from the web edge relative to the nozzle width, show that a drop of the heat-exchange coefficient $a_w$ begins at a spacing from the web edge of one nozzle width (D=1) and the heat-exchange coefficient $a_w$ at the web edge has a deviation A from the value in the center of the web of about 30%.

These measurements also show that the drop-off in the heat-exchange coefficient $a_w$ at the edges with a prior-art nozzle is greater with an increase of the spacing B of the measurement location from the nozzle. This agrees with observations that the effect of the insufficient drying of the edge with impregnated paper webs treated with large nozzles and substantial transverse movement is bigger than drying with paper webs in an offset-printing operation. Apparently the greater back-and-forth web movement aggravates the poor drying at the web edges.

OBJECTS OF THE INVENTION

It is therefore an object of the present invention to provide an improved air-cushion nozzle usable in a drying apparatus.

Another object is the provision of such an improved air-cushion nozzle usable in a drying apparatus which overcomes the above-given disadvantages, that is which effectively and thoroughly dries the web being treated across its entire width, and that also ensures good web travel wholly out of contact with the structure of the nozzle.

SUMMARY OF THE INVENTION

An air-cushion nozzle for an air-treatment device has according to the invention a hollow housing having an upper wall formed by a pair of end plates and a central plate. The end plates form with the central plate a pair of generally parallel slots directed upwardly generally toward each other and one of the end plates is formed adjacent and along a full length of the respective slot with an array of throughgoing holes. The central plate is substantially imperforate between the slots. The housing is internally pressurized, normally with hot air, to form from each nozzle an upwardly directed elongated jet of air and from each slot a respective upwardly directed further jet of air.

By providing the holes so that their drying jets impinge on the web outside the cushion of air created by the slots, drying is highly efficient and uniform across the entire width of the workpiece. The jets from these holes are concentrated in a dense band that is not disturbed by air flow from the slots. Another advantage is that the system of this invention maintains the web fairly stable, without the back-and-forth oscillation common with the prior-art systems.

Normally according to the invention the slot of the one end plate with the holes is of larger flow cross section than the other slot. Alternately the jets of air of the slots form respective acute angles with the horizontal and the angle of the jet of the slot of the one end plate with the holes is smaller than the angle of the jet of the slot of the other end plate.

In accordance with the invention the housing has an overall length measured perpendicular to the slots and the holes in the one end plate are in a field having a length measured perpendicular to the slots equal to between 5% and 15% of the housing length. This substantially decreases the transverse movement of the web, particularly when the field length is between 6% and 8% of the housing length.

The housing according to the invention has generally parallel and vertical end walls having upper edges from which the end plates project. The central plate has angled end sections parallel to and defining the respective slots with the respective end plates. The central plate is generally rectangular. Thus the nozzle assembly is a basically hollow box.

Furthermore in accordance with the invention the housing has vertical end walls having upper edges from which the end plates project, a bottom wall extending underneath the top wall and between the end walls, and vertical support plates extending substantially perpendicular to the slots and supporting the central plate on the end walls and bottom wall. These support plates not only carry the top-wall unit, but they also guide air out the nozzles, ensuring fairly smooth directed flow.

The holes according to the invention have an aggregate flow cross section and the slots and holes together have an aggregate flow cross section that is at least twice the aggregate flow cross section of the holes. More specifically the geometric opening degree of the holes is between 0.5% and 2% and the geometric opening degree of the slots is 1.7% to 4%. The geometric opening degree of the holes is defined as the flow cross section of the holes relative to the entire available drying surface, that is the length of the dryer times the width of the air-cushion nozzle, and the geometric opening degree of the entire slots as the overall nozzle flow cross section of the holes and of the nozzle relative to the entire available drying surface.

The jet of the slot of the one end plate extends at an angle of 10° to 30° to the horizontal and the jet of the slot of the other end plate at an angle of 45% to 80% to the horizontal, and the sum of the angles is 70% to 90%. More specifically the jet of the slot of the one end plate extends at an angle of 15° to 20° to the horizontal and the jet of the slot of the other end plate at an angle of 60% to 65% to the horizontal. Either way the sum of the two angles lies between 70° and 90°.

The slot according to the invention of the one end plate has a flow cross section that forms with a flow cross section of the slot of the other end plate a ratio between 1:1 and 3:1. In addition each end plate is formed with a perforated flap extending across the respective slot and bearing on the central plate.

According to this invention the nozzles are arranged in a dryer in two rows, one facing upward and one facing downward. The nozzles are spaced uniformly in the respective rows and the dryers of the one row are staggered so as to lie between the dryers of the other row. This causes the web to follow a slightly sinuous path through the dryer, for best drying effectiveness.

SPECIFIC DESCRIPTION

Figure 1:
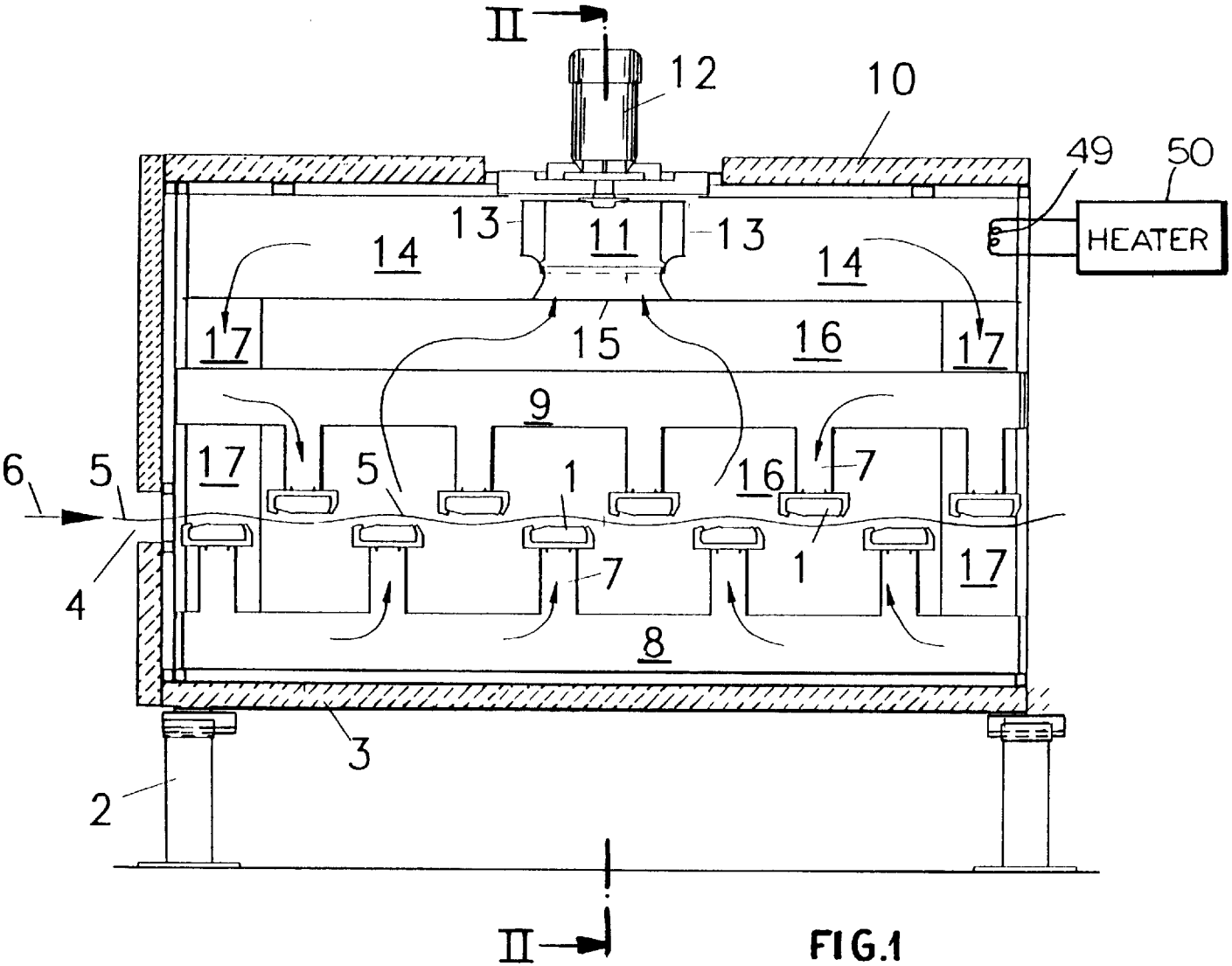
FIG. 1 is a small-scale longitudinal section, partly in diagrammatic form, through a drying apparatus according to the invention.
Figure 2:
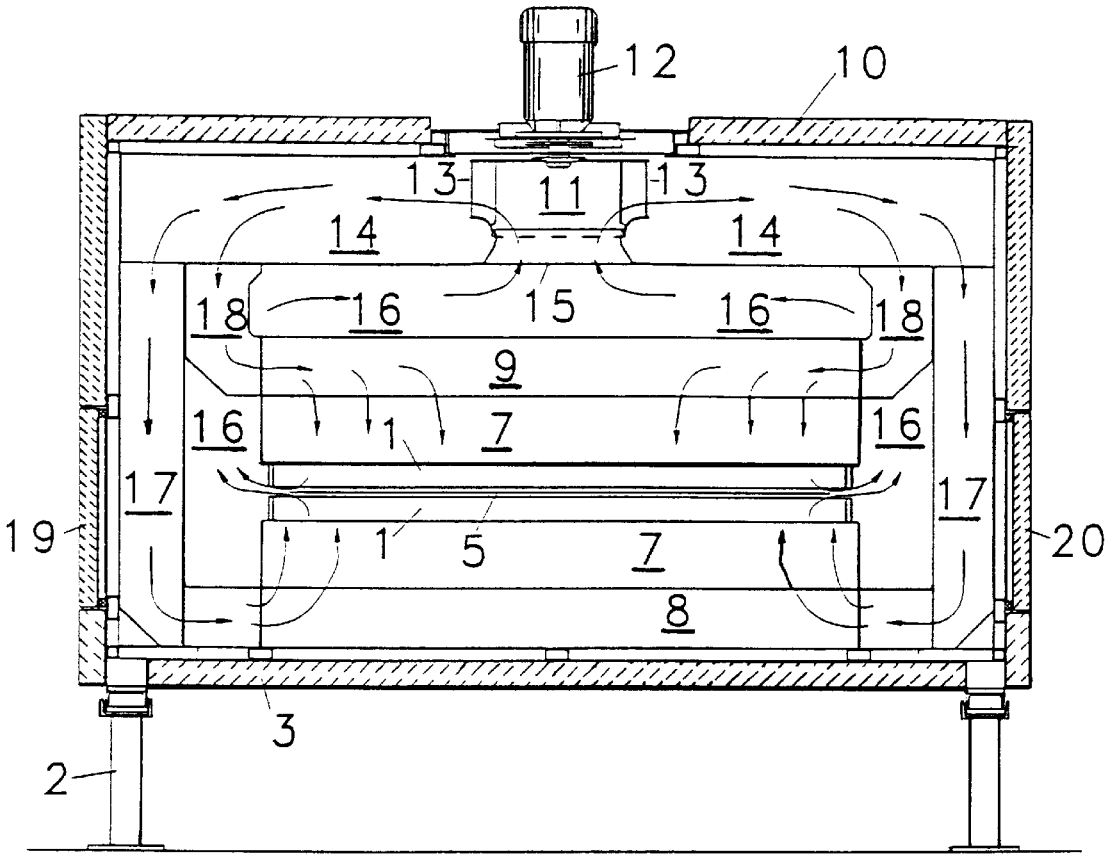
FIG. 2 is a cross section taken along line II—II of FIG. 1.

As seen in FIGS. 1 and 2 a drying apparatus according to this invention is provided with two sets of five identical air-cushion nozzles 1 held in a housing 3 supported by legs 2 and having at an upstream end an intake opening 4 through which the web 5 enters in a horizontal transport direction 6. Each of the nozzles 1 of the lower set is connected via a respective input duct 7 to a lower manifold 8 and each nozzle 1 of the upper set is similarly connected to an upper manifold 9.

An upper wall 10 of the housing 3 supports a fan 11 whose motor 12 is outside the housing 3. Vanes 13 of the fan 11 project air radially outward into an output chamber 14 provided with a heater coil 49 connected to a heater 50 and an intake chamber 16 opens into an axial input 15 of the fan 11. The output chamber 14 is connected via ducts 17 extending along side walls 19 and 20 of the housing 3 to the manifold 8 and ducts 18 to the manifold 9.

Figure 3:
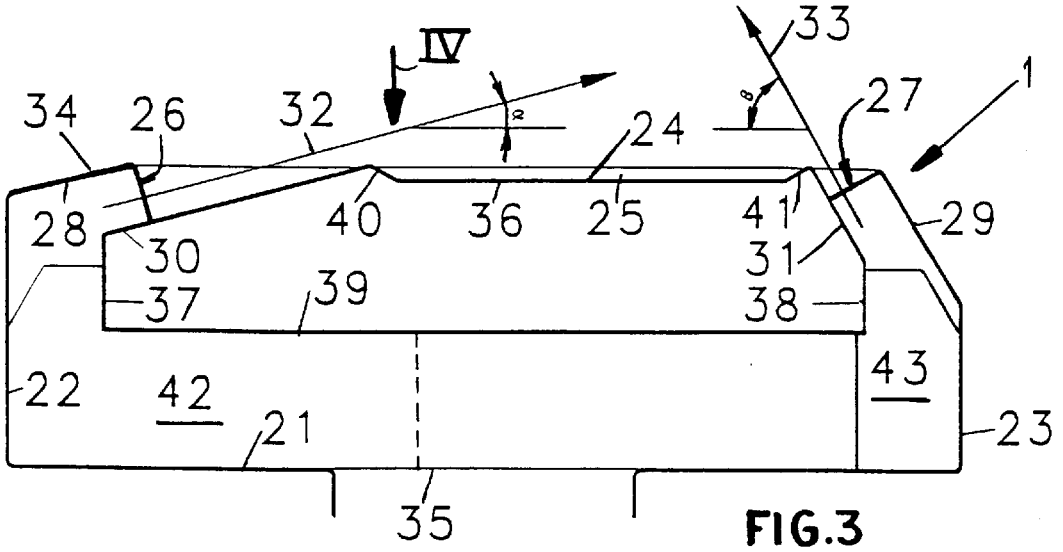
FIG. 3 is a cross section through a air-cushion nozzle according to the invention.
Figure 4:
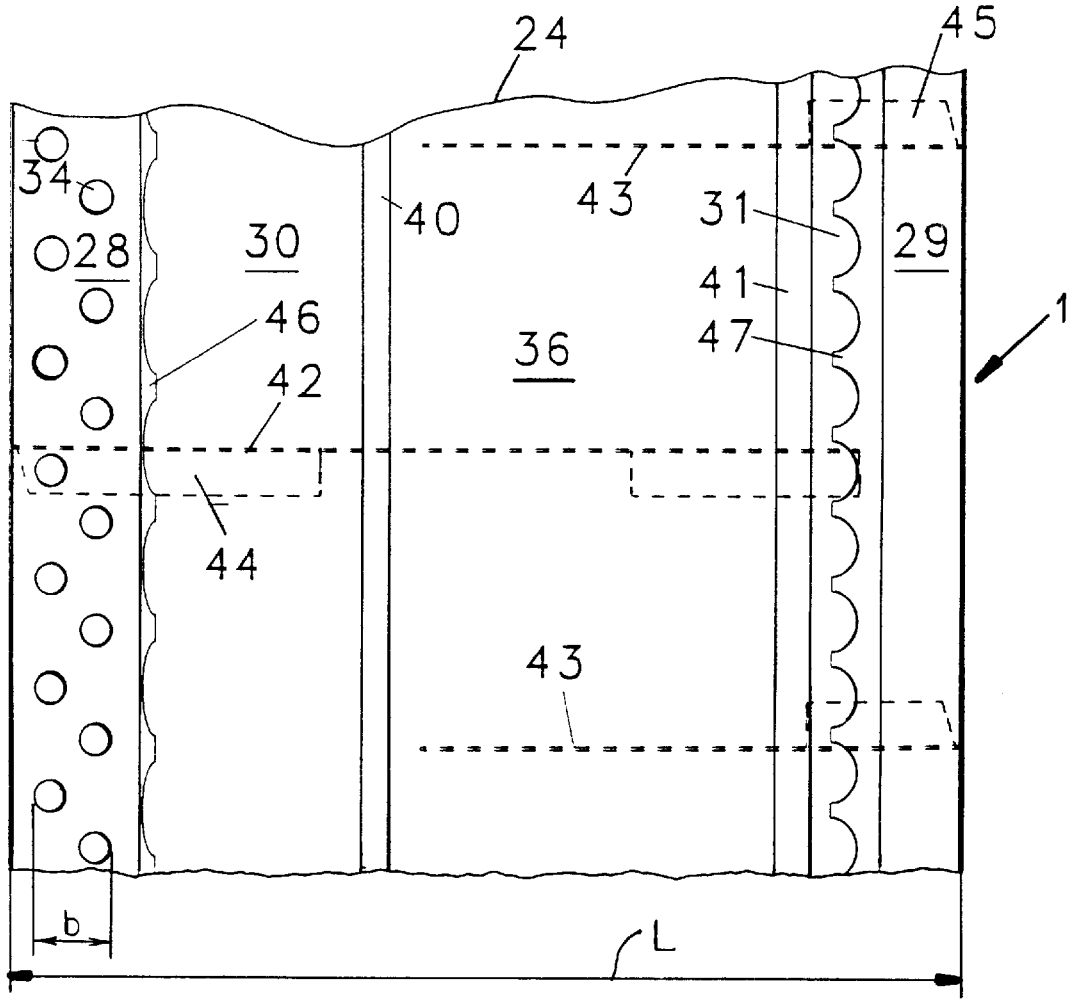
FIG. 4 is a top view taken in the direction of arrow IV of FIG. 3.
Figure 6:
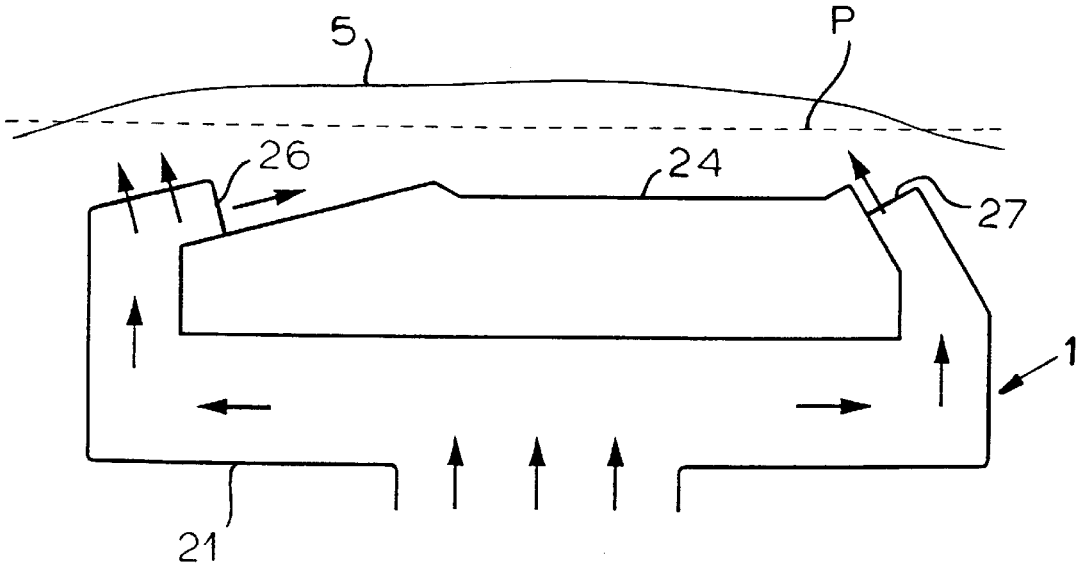
FIG. 6 is a view like FIG. 5 showing the nozzle of this invention.

As shown in FIGS. 3, 4, and 6 each nozzle 1 has a generally planar bottom wall or plate 21 formed with an opening 35 connected to the respective inlet duct 7 and a pair of vertical and planar end walls 22 and 23 extending perpendicular to the direction 6. A horizontal top wall 24 formed mainly by a planar and imperforate rectangular plate 25 defines an upstream slot 26 and a downstream slot 27 with respective angled end plates 28 and 29 extending from upper edges of the end plates 22 and 23. The top wall 24 further has, connected at ridges 40 and 41 at upstream and downstream ends of the plate 25, further planar end plates 30 and 31 parallel to the respective plates 28 and 29. Projecting vertically downward from lower edges of the plates 30 and 31 are short plates 37 and 38 extending parallel to the end walls 22 and 23 and having lower edges bridged by another planar floor plate 39 parallel to and spaced above the bottom wall 21, forming a rigid and hollow top wall assembly without openings. The upstream end plate 28 is formed with an array of circular holes 34. Vertical guide and support plates 42 and 43 engage the respective end walls 22 and 23 and the bottom wall 21 and support the top wall 24, while also serving to guide air in the unit. These plates 42 and 43 are connected by respective tabs or flanges 44 and 45 (FIG. 4) to the adjacent structures. Each end wall 23 and 29 is provided with a respective downwardly extending flap 46 and 47 which is perforated, here being formed with big semicircular cutouts, and which is braced against the respective plate 30 and 31 to ensure proper positioning of the top wall 24.

When the interior of the nozzle unit 1 is pressurized jets 32 and 33 will issue from the slots 26 and 27. The nozzle 26 is oriented such that the jet 32 extends at an angle $\alpha$ of between 10° and 30° to the plane P or to the horizontal, which are the same thing, preferably between 15° and 20°. The nozzle 27 is oriented such the jet extends at an angle $\beta$ of between 45° and 80°, preferably 60° and 65°. In any case the sum $\Sigma$ of angles $\alpha$ and $\beta$ is equal to between 70° and 90°. Here angle $\alpha$ equals 15° and angle $\beta$ equals 60° so sum $\Sigma$ equals 75°.

The ratio of the flow cross section of the slot 26 to that of the slot 27 is equal to between 1:1 and 3:1. Here it is equal to 1:1.

The nozzle 1 has an overall length in the direction 6 of 300 mm and a width measured horizontally transverse thereto of 2300 mm.

The holes 34 are arranged in one to five rows, here two being used, and extend the full transverse width of the nozzle 1, that is the full length of the respective slot 26. These holes 34 are arrayed in a field having a width b measured in the direction 6 equal to between 5% and 15%, preferably 6% to 8% of the overall length of the nozzle 1. Here there are 130 such holes 34 each 10 mm in diameter and the width b is 8% of the nozzle length L.

The overall flow cross section of the openings 34, which direct jets of air generally perpendicularly at the web 5, is less than 50%, preferably 20% to 40% of the overall flow cross section of the holes 34, nozzle 26, and nozzle 27. The geometric opening degree of the holes 34 is 0.5% to 2%, here 0.67% and the geometric opening degree of the overall nozzle 1.7% to 4%, here 2.8%.

In use the blower 11 circulates air in the system such that it exits from the holes 34 and slots 26 and 27 of the identical upper and lower nozzles 1, which are staggered across from each other. The web 5 passes between the upper and lower sets of nozzles 1 and is deflected alternately upward and downward while it is dried. The air impinging perpendicularly on the web 5 from the holes 34 serves to dry it effectively across its entire width, while the jets 32 and 33 serve to convey and support the web 5, with the nozzle 27 downstream of the respective nozzle 26.

Figure 9:
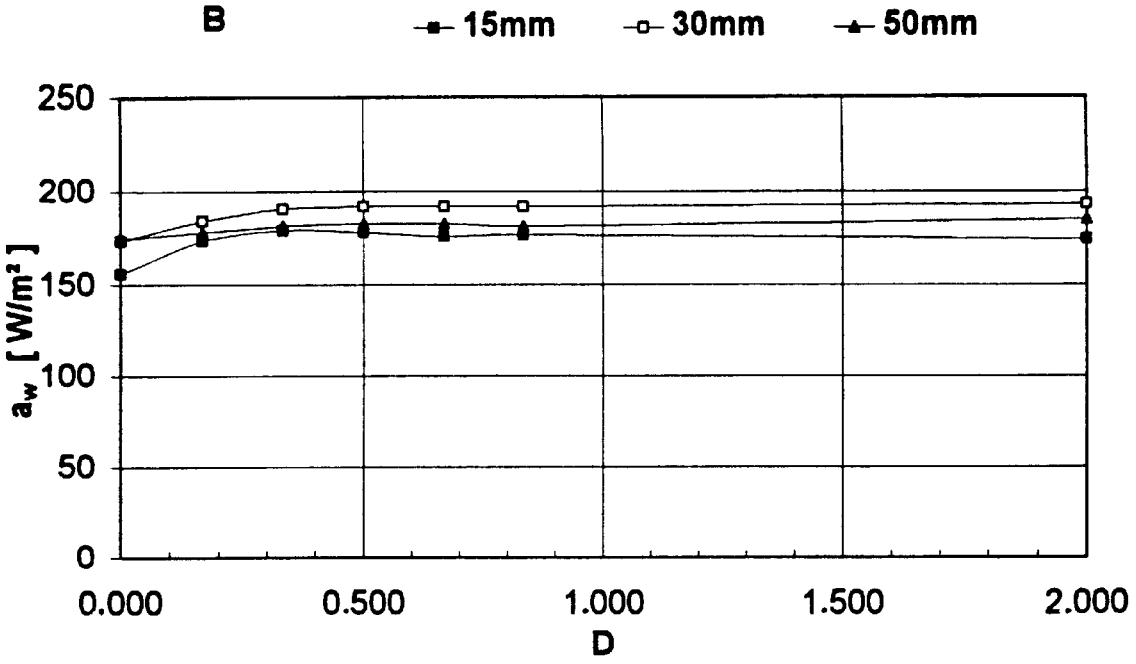
FIGS. 9 and 10 are graphs illustrating the system of this invention.
Figure 10:
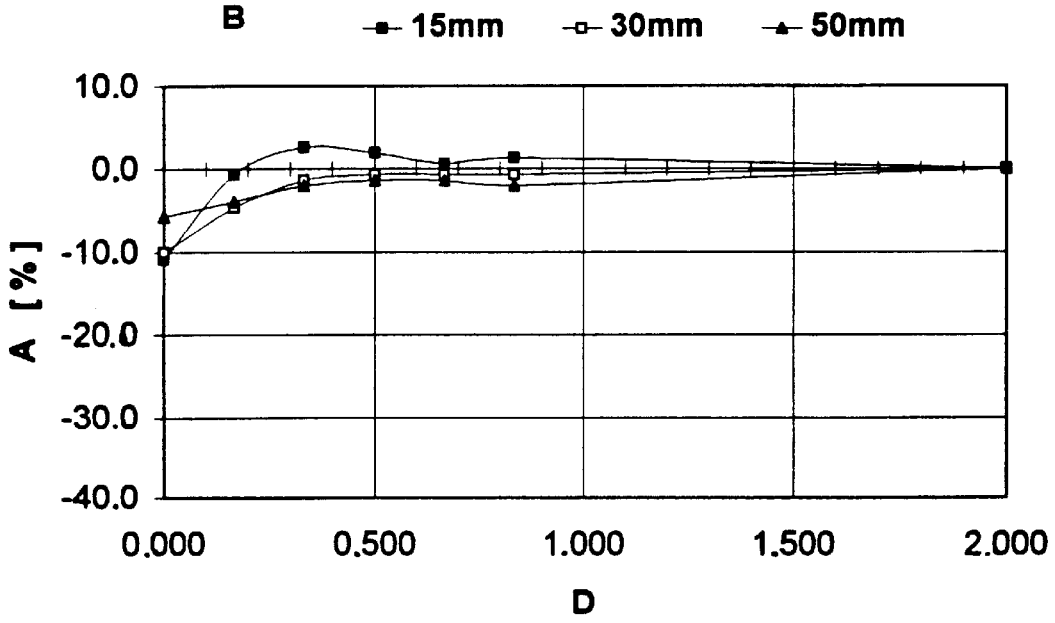

FIGS. 9 and 10 are plots of the operation of the system according to the instant invention, shown in the same manner as FIGS. 7 and 8 described above. The measurements of the heat-transfer coefficient $a_w$ in the system of this invention at the start of the drop-off in this coefficient $a_w$ at a spacing from the web edge of about 0.3% of the nozzle width (D=0.3) and at the web edge the heat-exchange coefficient $a_w$ deviates from the center by 10%.

These measurements also show that the drop-off of the heat-exchange coefficient at the edges as the spacing B from the measurement location to the nozzle increases. This agrees with the standard observation that the effect of insufficient drying of the edge regions when drying impregnated paper using large-format air-cushion nozzles and considerable spacings are greater than in dryers for offset-printed paper.

I claim:

1. An air-cushion nozzle for an air-treatment device, the nozzle comprising:

a hollow housing having an upper wall formed by a pair of end plates and a central plate, the end plates forming with the central plate a pair of generally parallel slots directed upwardly generally toward each other, one of the end plates being formed adjacent and along a full length of the respective slot with an array of through-going holes and the central plate being substantially imperforate between the slots, the slot of the one end plate being of larger flow cross section than the other slot; and means for internally pressurizing the housing with air and thereby forming from each nozzle an upwardly directed elongated jet of air and from each of the holes a respective upwardly directed further jet of air.

2. The air-cushion nozzle defined in claim 1 wherein the housing has generally parallel and vertical end walls having upper edges from which the end plates project, the central plate having angled end sections parallel to and defining the respective slots with the respective end plates.

3. The air-cushion nozzle defined in claim 1 wherein the central plate is generally rectangular.

4. The air-cushion nozzle defined in claim 1 wherein the housing further has:

vertical end walls having upper edges from which the end plates project;

a bottom wall extending underneath the top wall and between the end walls; and vertical support plates extending substantially perpendicular to the slots and supporting the central plate on the end walls and bottom wall.

5. The air-cushion nozzle defined in claim 1 wherein the jet of the slot of the one end plate extends at an angle of 10° to 30° to the horizontal and the jet of the slot of the other end plate at an angle of 45% to 80% to the horizontal, and the sum of the angles is 70% to 90%.

6. The air-cushion nozzle defined in claim 1 wherein the jet of the slot of the one end plate extends at an angle of 15° to 20° to the horizontal and the jet of the slot of the other end plate at an angle of 60% to 65% to the horizontal.

7. An air-cushion nozzle for an air-treatment device, the nozzle comprising:

a hollow housing having an upper wall formed by a pair of end plates and a central plate, the end plates forming with the central plate a pair of generally parallel slots directed upwardly generally toward each other, one of the end plates being formed adjacent and along a full length of the respective slot with an array of through-going holes and the central plate being substantially imperforate between the slots; and means for internally pressurizing the housing with air and thereby forming from each nozzle an upwardly directed elongated jet of air and from each of the holes a respective upwardly directed further jet of air, the jets of air of the slots forming respective acute angles with the horizontal, the angle of the jet of the slot of the one end plate being smaller than the angle of the jet of the slot of the other end plate.

8. An air-cushion nozzle for an air-treatment device, the nozzle comprising:

a hollow housing having an upper wall formed by a pair of end plates and a central plate, the end plates forming with the central plate a pair of generally parallel slots directed upwardly generally toward each other, one of the end plates being formed adjacent and along a full length of the respective slot with an array of through-going holes and the central plate being substantially imperforate between the slots, the housing having an overall length measured perpendicular to the slots and the holes in the one end plate being in a field having a length measured perpendicular to the slots equal to between 5% and 15% of the housing length; and means for internally pressurizing the housing with air and thereby forming from each nozzle an upwardly directed elongated jet of air and from each of the holes a respective upwardly directed further jet of air.

9. The air-cushion nozzle defined in claim 8 wherein the field length is between 6% and 8% of the housing length.

10. An air-cushion nozzle for an air-treatment device, the nozzle comprising:

a hollow housing having an upper wall formed by a pair of end plates and a central plate, the end plates forming with the central plate a pair of generally parallel slots directed upwardly generally toward each other, one of the end plates being formed adjacent and along a full length of the respective slot with an array of through-going holes and the central plate being substantially imperforate between the slots, the holes have an aggregate flow cross section and the slots and holes together have an aggregate flow cross section that is at least twice the aggregate flow cross section of the holes; and means for internally pressurizing the housing with air and thereby forming from each nozzle an upwardly directed elongated jet of air and from each of the holes a respective upwardly directed further jet of air.

11. The air-cushion nozzle defined in claim 10 wherein the geometric opening degree of the holes is between 0.5% and 2% and the geometric opening degree of the slots is 1.7% to 4%.

12. An air-cushion nozzle for an air-treatment device, the nozzle comprising:

a hollow housing having an upper wall formed by a pair of end plates and a central plate, the end plates forming with the central plate a pair of generally parallel slots directed upwardly generally toward each other, one of the end plates being formed adjacent and along a full length of the respective slot with an array of through-going holes and the central plate being substantially imperforate between the slots, the slot of the one end plate having a flow cross section that forms with a flow cross section of the slot of the other end plate a ratio between 1:1 and 3:1; and means for internally pressurizing the housing with air and thereby forming from each nozzle an upwardly directed elongated jet of air and from each of the holes a respective upwardly directed further jet of air.

13. An air-cushion nozzle for an air-treatment device, the nozzle comprising:

a hollow housing having an upper wall formed by a pair of end plates and a central plate, the end plates forming with the central plate a pair of generally parallel slots directed upwardly generally toward each other, one of the end plates being formed adjacent and along a full length of the respective slot with an array of through-going holes and the central plate being substantially imperforate between the slots, each end plate being formed with a perforated flap extending across the respective slot and bearing on the central plate; and means for internally pressurizing the housing with air and thereby forming from each nozzle an upwardly directed elongated jet of air and from each of the holes a respective upwardly directed further jet of air.

* * * * *